US008418845B2

(12) United States Patent
Tawada et al.

(10) Patent No.: US 8,418,845 B2
(45) Date of Patent: Apr. 16, 2013

(54) CIGARETTE BOX AND A BLANK SET THEREFOR

(75) Inventors: Shunsuke Tawada, Tokyo (JP); Tetsuya Nakamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/073,528

(22) Filed: Mar. 6, 2008

(65) Prior Publication Data

US 2008/0164158 A1 Jul. 10, 2008

Related U.S. Application Data

(63) Continuation of application No. PCT/JP2006/316255, filed on Aug. 18, 2006.

(30) Foreign Application Priority Data

Sep. 8, 2005 (JP) ..... 2005-260663

(51) Int. Cl.
*A24F 15/00* (2006.01)
*B65D 85/10* (2006.01)
*B65D 85/12* (2006.01)

(52) U.S. Cl.
USPC ..... 206/267; 206/268; 206/273; 229/125.08

(58) Field of Classification Search ..... 206/273, 206/268, 236, 266, 221, 267, 263–264; 229/87.13, 229/125.37
See application file for complete search history.

(56) References Cited

U.S. PATENT DOCUMENTS

| | | | | | |
|---|---|---|---|---|---|
| 1,249,910 | A | * | 12/1917 | Deginder | 220/842 |
| 1,735,323 | A | * | 11/1929 | Enfant | 206/251 |
| 3,052,398 | A | * | 9/1962 | Benjamin | 229/125.37 |
| 3,583,625 | A | * | 6/1971 | Gero | 206/264 |
| 3,749,234 | A | * | 7/1973 | Gero | 206/266 |
| 3,881,599 | A | * | 5/1975 | Flaherty | 206/273 |
| 4,172,520 | A | | 10/1979 | Gero | |
| 4,534,463 | A | * | 8/1985 | Bouchard | 206/267 |
| 4,641,748 | A | * | 2/1987 | Lewis et al. | 206/263 |
| 5,682,986 | A | * | 11/1997 | Cobler | 206/265 |

FOREIGN PATENT DOCUMENTS

| | | | |
|---|---|---|---|
| DE | 3414214 | A1 | 10/1985 |
| JP | 48-24760 | B1 | 7/1973 |
| JP | 56-57660 | A | 5/1981 |
| JP | 5-213340 | A | 8/1993 |

* cited by examiner

*Primary Examiner* — Mickey Yu
*Assistant Examiner* — Chun Cheung
(74) *Attorney, Agent, or Firm* — Birch, Stewart, Kolasch & Birch, LLP

(57) ABSTRACT

A cigarette box has an outer case (2) provided in a portion of a bottom wall (14) thereof with a movable base (22) capable of turning around a hinge (20), and an inner case (4) disposed in the outer case (2), the inner case (4) holding an inner pack of cigarettes. The inner case (4) is connected to the movable base (22) only at a bottom wall (26) thereof, and protrudes from an open face (6) of the outer case (2) in a lateral direction of the outer case (2) when turned around the hinge (22) together with the movable base (22), which opens the cigarette box.

5 Claims, 14 Drawing Sheets

CIGARETTE BOX AND A BLANK SET THEREFOR

This application is a Continuation of copending PCT International Application No. PCT/JP2006/316255 filed on Aug. 18, 2006, which designated the United States, and on which priority is claimed under 35 U.S.C. §120. This application also claims priority under 35 U.S.C. §119(a) on Patent Application No(s). 2005-260663 filed in Japan on Sep. 8, 2005. The entire contents of each of the above documents is hereby incorporated by reference.

TECHNICAL FIELD

The present invention relates to a cigarette box and a blank set therefor. The cigarette box is used for containing an inner pack. The inner pack has a bundle of filter cigarettes or cigarettes and a wrapping material wrapping the bundle.

BACKGROUND ART

A so-called hinged-lid package has widely been used for a cigarette box of this type. The package includes a box body and a lid for opening/closing the box body, and the inner pack is contained in the box body, for example, as in Unexamined Japanese Patent Application No. 5-213340.

As such a package style has been familiar to smokers and other people for long, there is no newness in the action of opening and closing such a package. Therefore, the package does not have enough visual appeal to arouse customers' interest.

It is an object of the invention to provide a cigarette box having such an innovative opening/closing style as to encourage users to buy, and a blank set therefor.

DISCLOSURE OF THE INVENTION

In order to accomplish the object, the cigarette box according to the invention has an outer case including one side face opened, the other side wall with a push window, and a bottom wall extending from the open face to the other side wall, the bottom wall in which one portion located on the side of the open face being connected to the other portion across a hinge and formed as a movable base; an inner case that is contained in the outer case, holds an inner pack and protrudes from the open face of the outer case in a lateral direction of the outer case when pushed through the push window of the outer case, the inner case including an outer side wall that covers the open face of the outer case, an inner side wall exposed through the push window of the outer case, a bottom wall coupled to the movable base of the outer case for allowing the inner case to turn on the hinge together with the movable base; and a stopper for controlling a maximum turning angle of the inner case when the inner case protrudes.

According to the cigarette box, when a user pushes the inner case with a finger through the push window of the outer case, the inner case turns around the hinge and protrudes from the open face of the outer case in the lateral direction of the outer case. The cigarette box is thus opened. When the cigarette box is in this open position, the user can remove a rod-like smoking article, such as a filter cigarette and a cigarette, from the inner pack contained in the inner case. When the user later pushes the inner case back into the outer case, the open face of the outer case is closed by the outer side wall of the inner case. In this way, the cigarette box is closed.

An opening/closing style of the cigarette box is quite different from that of conventional hinged-lid packages. Moreover, when the cigarette box of the invention is open, it shows a unique appearance, which promotes customers' motivation for buying the cigarettes contained in such a cigarette box.

More specifically, the inner case further includes a pull-up mouth for the cigarettes, which is positioned outside the outer case when the inner case protrudes from the outer case. In this case, the pull-up mouth is preferably formed from one portion of an upper wall of the inner case into front and rear walls of the inner case.

To be more concrete, the stopper is capable of determining the maximum turning angle by engaging the inner case with a ceiling face of the outer case. Specifically, the stopper includes a fixed element provided to the ceiling face of the outer case and a movable element that protrudes from the inner side wall of the inner case and is engaged with the fixed element when the inner case is turned in a protruding direction.

The stopper is also capable of determining the maximum turning angle by engaging the inner case with an inner surface of at least one of the front and rear walls of the outer case. Specifically, the stopper includes a fixed element provided to the inner surface of the outer case and a movable element that is provided to an inner surface of the inner case, which faces the inner surface of the outer case, and is engaged with the fixed element when the inner case is pivoted in the protruding direction.

Before the inner case is turned for the first time, the cigarette box may further include a perforation line that detachably connects the front and rear walls of the outer case to the movable base.

In the case of such a cigarette box, the stopper may have a locking groove formed in the ceiling face of the outer case, a first stopper element that is provided to the inner case and determines first opening of the inner case when engaged with the locking groove, a locking liner that is superposed upon the inner surface of at least one of the front and rear walls of the outer case, and a second stopper element that is provided to the inner case and determines second opening of the inner case when engaged with the locking liner. Preferably, the second opening is larger than the first opening.

The invention also provides a blank set for fabricating the cigarette box. The blank set will be clearly illustrated in the attached drawings and under Best Mode of Carrying out the Invention.

BEST MODE FOR CARRYING OUT THE INVENTION

Figure 1:
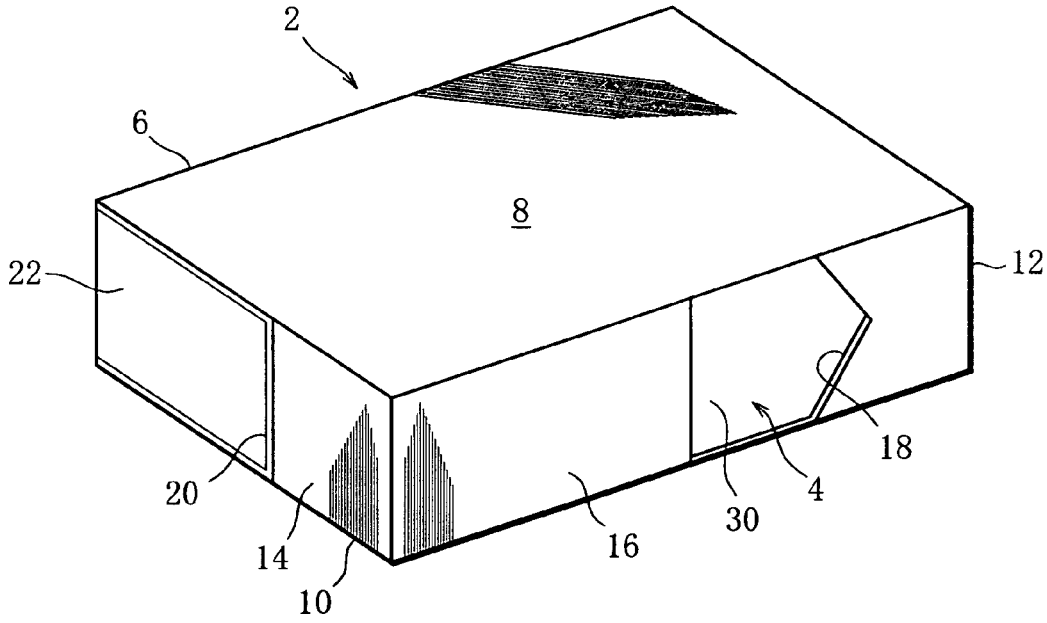
FIG. 1 is a perspective view showing a cigarette box of a first embodiment.
Figure 2:
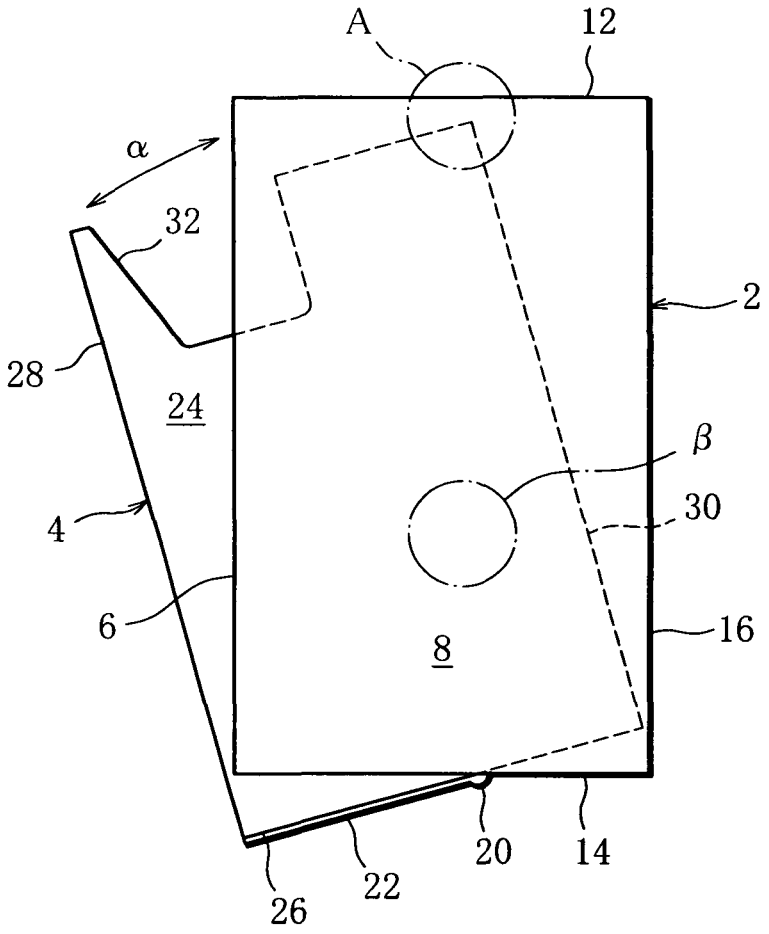
FIG. 2 is a front view of a cigarette when the cigarette box of FIG. 1 is open.

FIGS. 1 and 2 show a cigarette box of a first embodiment. The cigarette box has a double structure and includes an outer case 2 and an inner case 4. The outer case 2 has a rectangular parallelepiped shape and has a front wall 8, a rear wall 10, an upper wall 12 and a bottom wall 14. The outer case 2 further has one side face that is open through the entire surface, namely an open face 6, and the other side face, namely a side wall 16. The side wall 16 has a push window 18 in an upper portion thereof. The push window 18 partially exposes the inner case 4. The push window 18 may have an arbitrary shape. In this embodiment, the push window 18 has an upper edge in the shape of a triangle protruding toward the upper wall 12 and, as a whole, is formed in the shape of a pentagon.

As illustrated in FIG. 1, the bottom wall 14 of the outer case 2 has a self hinge 20 virtually in the center thereof. The self hinge 20 extends across the bottom wall 14. The bottom wall 14 is divided by the self hinge 20 into a movable base 22 located on the side of the open face 6 and a fixed other portion located on the side of the side wall 16. The movable base 22 is not connected to any of the front wall 8 and the rear wall 10 of the outer case 2, and is allowed to turn around the self hinge 20.

The inner case 4 has a rectangular parallelepiped shape similar to the outer case 2 and is of a size containable in the outer case 2. In other words, the inner case 4 also has a front wall 24, a rear wall and a bottom wall 26, and these walls are superposed upon the front wall 8, the rear wall 10 and the bottom wall 14, respectively, of the outer case 2. The inner case 4 further has side walls 28 and 30. When the inner case 4 is thoroughly contained in the outer case 2, the outer side wall 28 closes the open face 6 of the outer case 2, and the inner side wall 30 is superposed upon the side wall 16 of the outer case 2. At this time, a part of the inner side wall 30 is exposed through the push window 18 of the side wall 16.

The bottom wall 26 of the inner case 4 is bonded to the outer case 2 only at the movable base 22 of the outer case 2. Therefore, the inner case 4 is capable of turning around the self hinge 20 together with the movable base 22. Consequently, when a user pushes the inner side wall 30 of the inner case 4 through the push window 18 of the outer case 2, as is obvious from FIG. 2, the inner case 4 turns around the self hinge 20 together with the movable base 22, and a part of the inner case 4, which is on the side of the outer side wall 28 of the inner case 4, then protrudes sideways from the open face 6 of the outer case 2.

The inner case 4 holds an inner pack, not shown in FIGS. 1 and 2. The inner pack includes a bundle of smoking articles, such as filter cigarettes and cigarettes, and a wrapping material wrapping the bundle therein.

The inner case 4 has an open upper end. Each of the front wall 24 and the rear wall of the inner case 4 has an access notch in an upper edge thereof. These access notches are situated on the side of the outer side wall 28 of the inner case 4, and are in the shape of a substantial U extending from the upper edges of the respective walls toward the bottom wall 26 of the inner case 4. Such access notches form a pull-up mouth 32 of the inner case 4 in cooperation with the open face formed in an upper end of the inner case 4.

As illustrated in FIG. 2, when the inner case 4 protrudes from the outer case 2, the pull-up mouth 32 of the inner case 4 is located outside the outer case 2, thereby opening the cigarette box. When the cigarette box is open, the user can remove a smoking article from the inner pack through the pull-up mouth 32 and smoke the smoking article that has been taken out.

If the user pushes the inner case 4 into the outer case 2 in the open state of the cigarette box illustrated in FIG. 2, the pull-up mouth 32 of the inner case 4 moves into the outer case 2, and the open face 6 of the outer case 2 is closed by the outer side wall 28 of the inner case 4. In other words, the cigarette box is brought from the open state into a closed state shown in FIG. 1.

The cigarette box further includes a stopper to determine allowable protrusion opening $\alpha$ of the inner case 4 at the time when the inner case 4 protrudes from the outer case 2, that is, allowable turn angle of the inner case 4 around the self hinge 20. For example, such a stopper engages the ceiling face of the outer case 2 with the inner case 4 at a circle A shown by a dashed line in FIG. 2, or alternatively engages the front and rear walls of the cases 2 and 4 with each other at a circle B shown by a dashed line in FIG. 2. A specific structure of the stopper will become clear from the following descriptions of a blank.

As described above, in the case of the cigarette box according to one embodiment, the cigarette box is opened or closed when the inner case 4 turns around on the self hinge 20 with respect to the outer case 2, that is, when the inner case 4 tilts sideways. Such a cigarette box has a unique opening/closing style and unique appearance in the open state, as compared to conventional hinged-lid packages, to thereby promotes customers' motivation for buying the cigarettes contained in the cigarette box of the invention.

Figure 3:
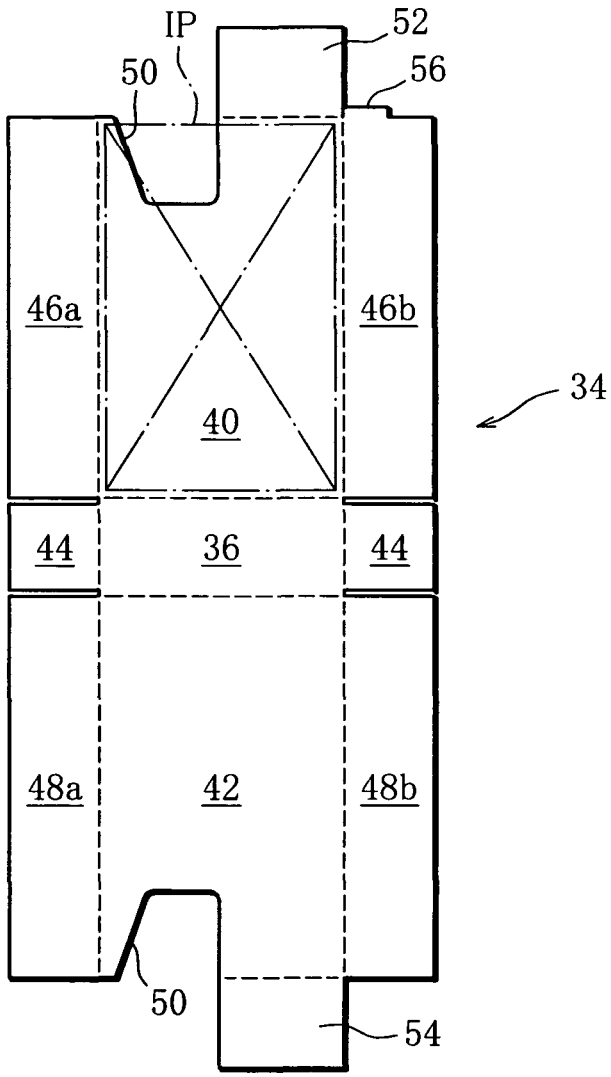
FIG. 3 shows an inner blank for fabricating an inner case of FIG. 1.

FIG. 3 shows the inside of an inner blank 34 for fabricating the inner case 4.

The inner blank 34 includes a plurality of panels and flaps. Adjacent panels and flaps are demarcated by fold lines shown by broken lines.

More specifically, the inner blank 34 has a rear panel 40, a bottom panel 36, and a front panel 42 that are aligned on a longitudinal axis of the inner blank 34. Inner bottom flaps 44 are connected to both side edges of the bottom panel 36. The panels 36, 40 and 42 are parts for forming the bottom wall 26, the rear wall and the front wall 24 of the inner case 4. The inner bottom flaps 44 form reinforcing members for the bottom wall 26.

Inner side flaps 46*a* and 46*b* are connected to both side edges of the rear panel 40, and outer side flaps 48*a* and 48*b* to both side edges of the front panel 42. The inner and outer side flaps 46*a* and 48*a* are parts for forming the outer side wall 28 of the inner case 4, whereas the inner and outer side flaps 46*b* and 48*b* are parts for forming the inner side wall 30 of the inner case 4.

In FIG. 3, a substantially U-shaped access notch 50 is formed in a left half of an upper edge of the rear panel 40 and in a left half of a lower edge of the front panel 42. Connected to the other portions of the upper and lower edges are an inner top flap 52 and an outer top flap 54, respectively. The inner top flap 52 and the outer top flap 54 are parts for forming the upper wall of the inner case 4. There is secured the pull-up mouth 32 in between the upper wall and the outer side wall 28. The pull-up mouth 32 includes the access notch 50.

In FIG. 3, a left half of an upper edge of the inner side flap 46*b* protrudes farther than the other portion of the upper edge, and forms a projection 56 serving as a movable element of the stopper. The projection 56 may be formed in a lower edge of the outer side flap 48*b* or in both the side flaps 46*b* and 48*b*.

Figure 4:
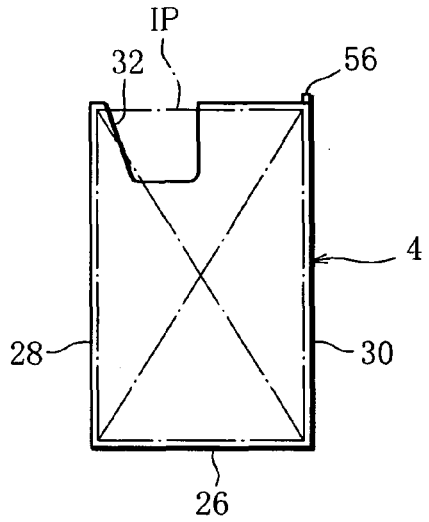
FIG. 4 is a front view of the inner case fabricated out of the inner blank of FIG. 3.

The blank 34 is applied with glue in a given region of the inside thereof, and an inner pack IP is placed on the rear panel 40 of the blank 34. Subsequently, the blank 34, that is, the flaps and panels thereof are folded in order around the inner pack IP, to thereby fabricate the inner case 4 shown in FIG. 4. The side flaps for forming the outer and inner side walls of the inner case 4 are bonded together in a position superposed on each other. The rear panel 40 and the front panel 42 are bonded to the inner pack IP. As is apparent from FIG. 4, the projection 56 protrudes from the upper edge of the inner side wall 30 of the inner case 4.

Figure 5:
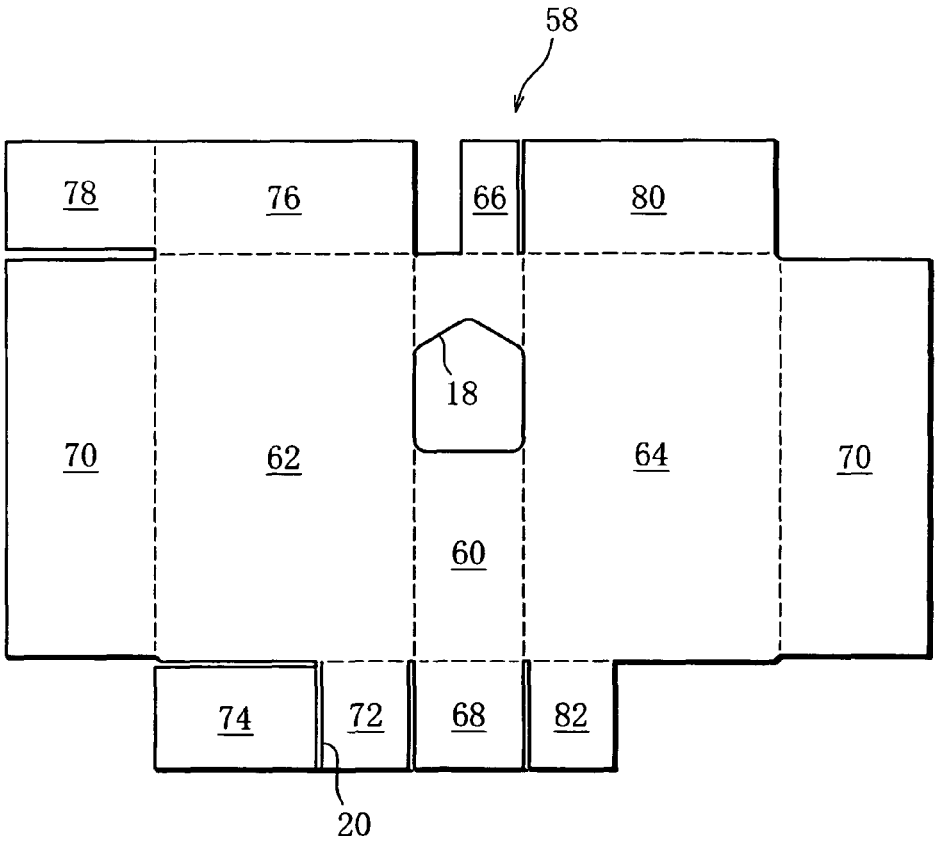
FIG. 5 shows an outer blank for fabricating an outer case of FIG. 1.

FIG. 5 shows the inside of an outer blank 58 for fabricating the outer case 2.

The outer blank 58 also includes a plurality of panels and flaps. Adjacent panels and flaps are demarcated from each other by fold lines shown by broken lines.

More specifically, the outer blank 58 includes a side panel 60 in the center of longitudinal axis thereof. The side panel 60 is a part for forming the outer side wall 16 of the outer case 2, and has the push window 18 in a upper portion thereof, as viewed in FIG. 5.

A rear panel 62 and a front panel 64 are connected to both side edges of the side panel 60. The panels 62 and 64 are parts for forming the rear wall 10 and the front wall 8, respectively, of the outer case 2. An inner top flap 66 and an inner bottom flap 68 are connected to upper and lower edges, respectively, of the side panel 60. The inner top flap 66 forms a reinforcing member for the upper wall 12 of the outer case 2, and the inner bottom flap 68 for the bottom wall 14 of the outer case 2.

As is clear from FIG. 5, it should be noted that the inner top flap 66 has a width smaller than that of the side panel 60, and that the inner top flap 66 is situated adjacent to the front panel 64.

Folding flaps 70 are connected to the other side edge of the rear panel 62 and of the front panel 64. The folding flaps 70 are parts for forming liners of the front wall 8 and the rear wall 10 of the outer case 2.

An outer bottom flap 72 is connected to a part of a lower edge of the rear panel 62. The outer bottom flap 72 is situated adjacent to the inner bottom flap 68. An extension flap 74 is connected to a side edge of the outer bottom flap 72 across the self hinge 20. The extension flap 74 extends along the other part of the lower edge of the rear panel 62. The extension flap 74 is a part for forming the movable base 22 that is a part of the bottom wall 14 of the outer case 2. The outer bottom flap 72 is a part for forming the other part of the bottom wall 14 of the outer case 2.

An inner top panel 76 is connected to the upper edge of the rear panel 62. The inner top panel 76 has a locking flap 78 in a side edge located opposite to the side panel 60. The locking flap 78 is situated above the corresponding folding flap 70 and is a part for forming the fixed element of the stopper.

An outer top panel 80 is connected to an upper edge of the front panel 64, and a middle bottom flap 82 to a part of a lower edge of the front panel 64. The middle bottom flap 82 is disposed adjacent to the inner bottom flap 68. Therefore, the inner bottom flap 68 is so situated as to be sandwiched between the outer bottom flap 72 and the middle bottom flap 82. The flaps 68, 72 and 82 are of virtually the same-shape and size.

The outer blank 58 is applied with glue in a given region of the inside thereof. The outer blank 58 is then folded according to a folding process shown in FIGS. 6 to 10, to thereby fabricate the outer case 2 containing the inner case 4.

Figure 6:
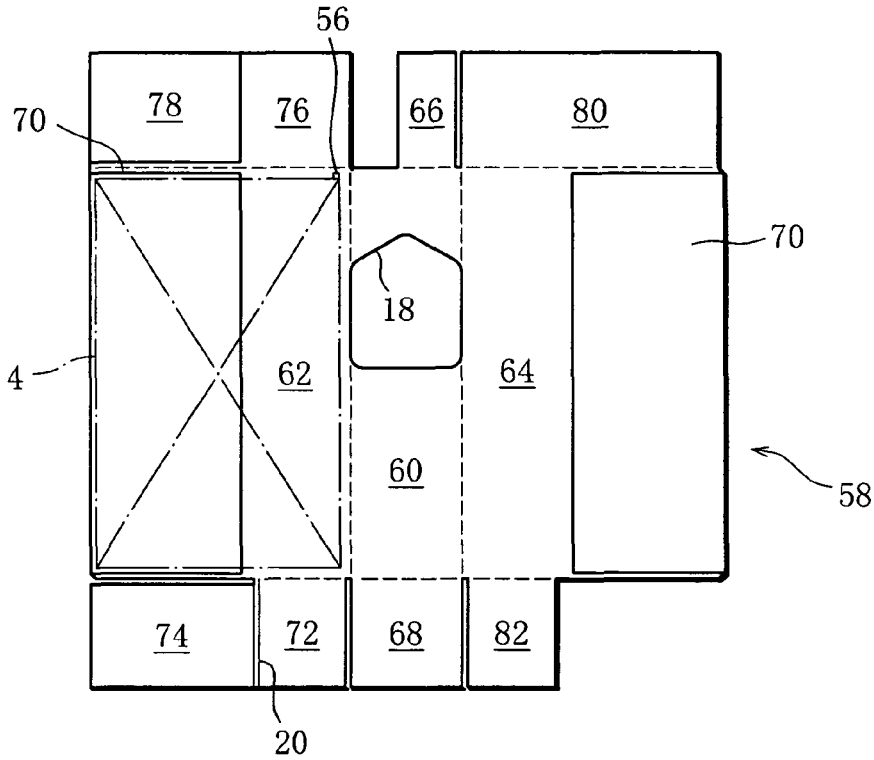
FIG. 6 shows a folding process of the outer blank of FIG. 5.

More specifically, the right and left folding flaps 70 are first folded as illustrated in FIG. 6. The folding flaps 70 are superposed on the rear panel 62 and the front panel 64. Simultaneously with the folding of the folding flaps 70, the locking flap 78 is also folded and superposed on the inner top panel 76.

Thereafter, the inner case 4 is placed on the rear panel 62, and one of the folding flaps 70 is sandwiched between the inner case 4 and the rear panel 62. In this state, the side panel 60 is folded toward the inner case 4 together with the front panel 64 and others, and is superposed on the inner side wall 30 of the inner case 4.

Figure 7:
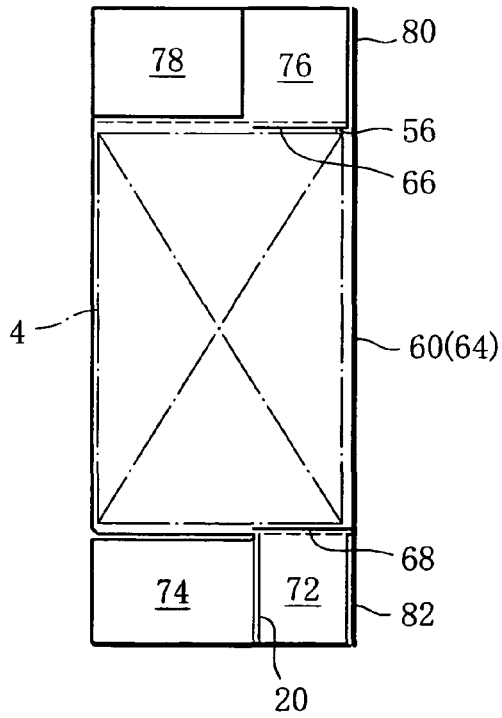
FIG. 7 shows a state in which the outer blank is further folded from the state shown in FIG. 6.
Figure 8:
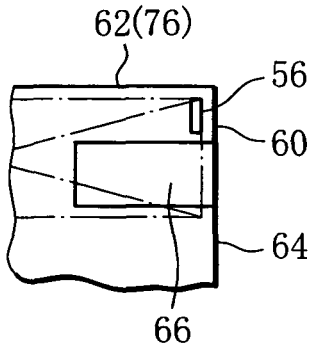
FIG. 8 shows a configurational relationship between an projection of the inner case and an inner top flap in the state shown in FIG. 7.

In this state, as illustrated in FIG. 7, the inner top flap 66 and the inner bottom flap 68 of the side panel 60 are folded toward and superposed on the upper and bottom walls, respectively, of the inner case 4. At this time, as is obvious from FIG. 8, the inner top flap 66 is folded, avoiding the projection 56 of the inner case.

Figure 9:
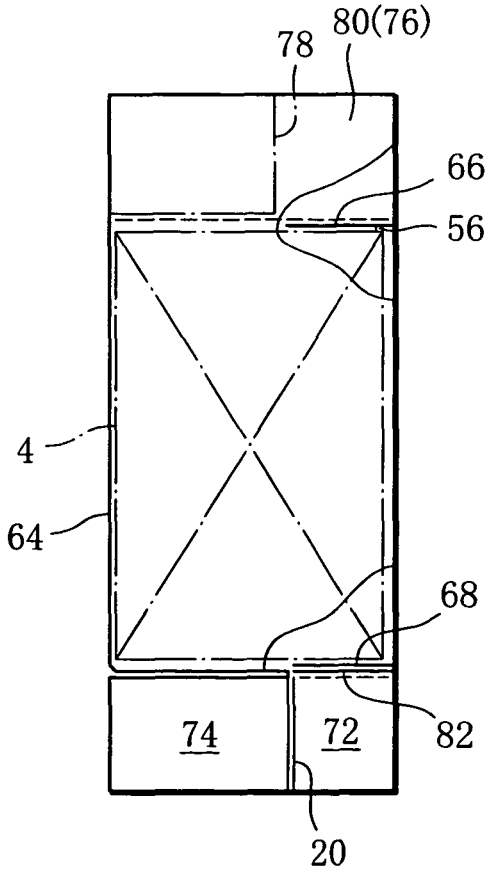
FIG. 9 shows a state in which the outer blank is further folded from the state shown in FIG. 7.

In the next place, the front panel 64 is folded toward the front wall of the inner case 4 and superposed on the front wall of the inner case 4 as illustrated in FIG. 9. The middle bottom flap 82 of the front panel 64 is folded toward the bottom wall of the inner case 4. The middle bottom flap 82 is superposed on the inner bottom flap 68 that has already been folded. In this state, the outer bottom flap 72 is folded toward the bottom wall of the inner case 4 together with the extension flap 74. Consequently, as illustrated in FIG. 10, the outer bottom flap 72 is superposed on and bonded to the middle bottom flap 82, and the extension flap 74, or the movable base 22, is bonded to the bottom wall of the inner case 4.

Figure 10:
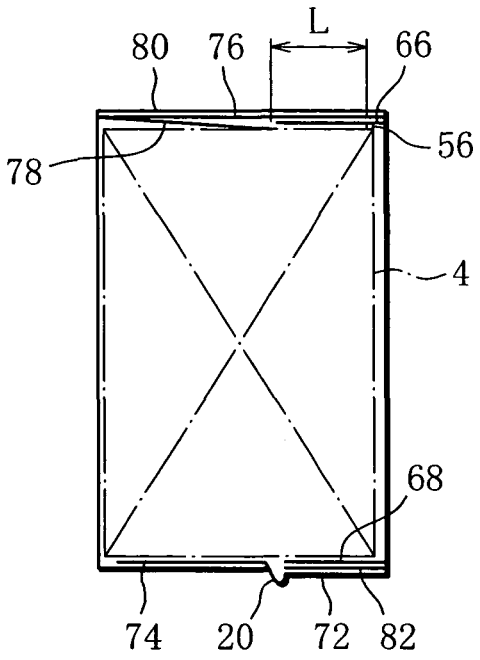
FIG. 10 shows a state in which the outer blank is further folded from the state shown in FIG. 9.

As is apparent from FIG. 10, simultaneously with the folding of the outer bottom flap 72, the inner top panel 76 and the outer top panel 80 are folded in order toward the upper wall of the inner case 4. The inner and outer top panels 76 and 80 are superposed on each other. The panels 76 and 80 are bonded together and form the upper wall 12 of the outer case 2. At this time, the cigarette box is completed. This cigarette box includes the outer and inner cases 2 and 4.

The locking flap or locking liner 78 of the inner top panel 76 is not bonded to the inner top panel 76. Therefore, as is clear from FIG. 10, the locking flap or locking liner 78 is inclined toward the upper wall of the inner case 4 due to restoring force of the locking flap or locking liner 78, and has an end that is in contact with the upper wall of the inner case 4.

For this reason, when the inner case 4 is pivoted on the self hinge 20 in an opening direction, the projection or first stopper 56 of the inner case 4 is brought into contact to the end of the locking flap or locking liner 78. This limits a turn angle of the inner case 4, that is, protrusion opening of the inner case 4 when the inner case 4 protrudes from the outer case 2. Maximum protrusion opening or first opening a (see FIG. 2) is determined by distance L between the end of the locking flap or locking liner 78 and the projection or first stopper 56 when the cigarette box is in the closed position.

The projection or first stopper 56 and the locking flap or locking liner 78 form the stopper for the inner case 4. The stopper engages the ceiling face of the outer case 2 and the upper wall of the inner case 4 with each other at the position A in FIG. 2.

A cigarette box of a second embodiment will be described below.

In the cigarette box of the second embodiment, an outer case 2 and an inner case 4 can be engaged with each other at a position B in FIG. 2. An inner blank 34' and an outer blank 58' for fabricating the cigarette box of the second embodiment will be described below with reference to FIGS. 11 and 14.

In descriptions of the blanks 34' and 58', panels and flaps offering functions identical to those of the panels and flaps of the inner blank 34 and the outer blank 58 are provided with identical reference numerals in FIGS. 11 to 14 to avoid overlap of explanations.

Figure 11:
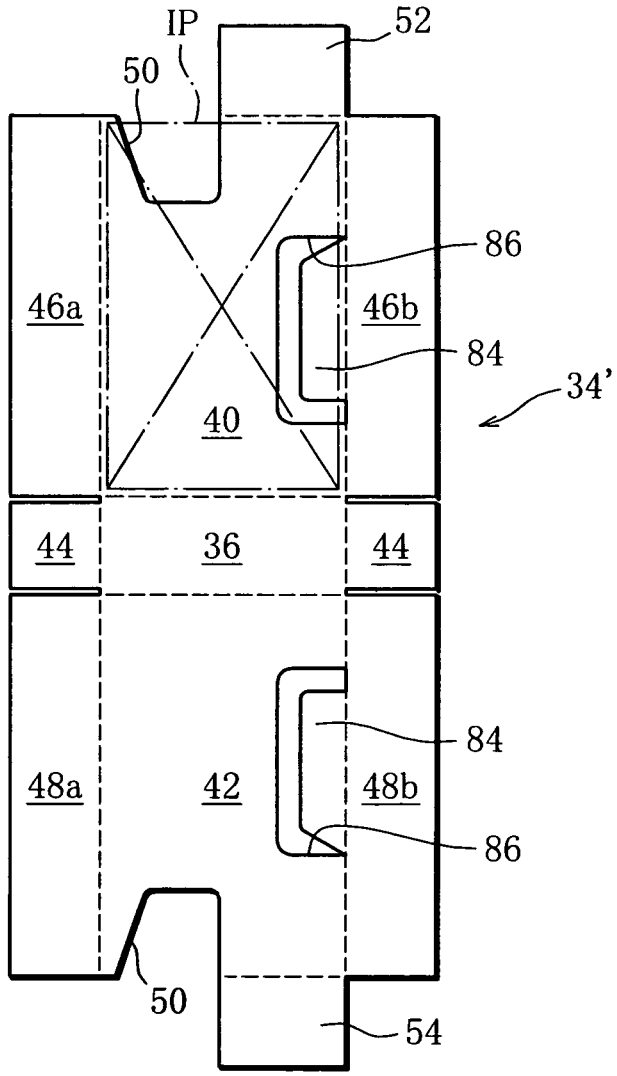
FIG. 11 shows an inner blank of a second embodiment, which is for fabricating an inner case.

FIG. 11 shows the inner blank 34' for the inner case 4.

The inner blank 34' has a pair of lug regions 84 instead of the projection 56. The lug regions 84 are produced by forming substantially U-shaped openings 86 in a rear panel 40 and a front panel 42. The openings 86 are located adjacent to inner and outer side flaps 46*b* and 48*b*.

More specifically, the lug regions 84 have fold lines in common with the respective side flaps (46*b* and 48*b*). Before the inner blank 34' starts to be folded along the fold lines, the lug regions 84 are folded toward outer surface-sides of the rear and front panels 40 and 42, to thereby form lugs or second stopper 85.

Figure 12:
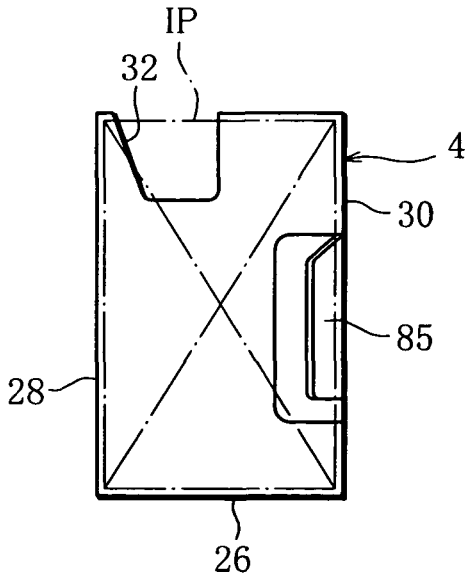
FIG. 12 shows an inner case fabricated out of the inner blank of FIG. 11.

Thereafter, the inner blank 34' is folded around an inner pack IP as with the blank 34. As a result, the inner case 4 as illustrated in FIG. 12 is fabricated. At this time, the lugs or second stopper 85 are slightly raised from front and rear walls of the inner case 4 and ends of the lugs or second stopper 85 are oriented toward an outer side wall 28 of the inner case 4.

Figure 13:
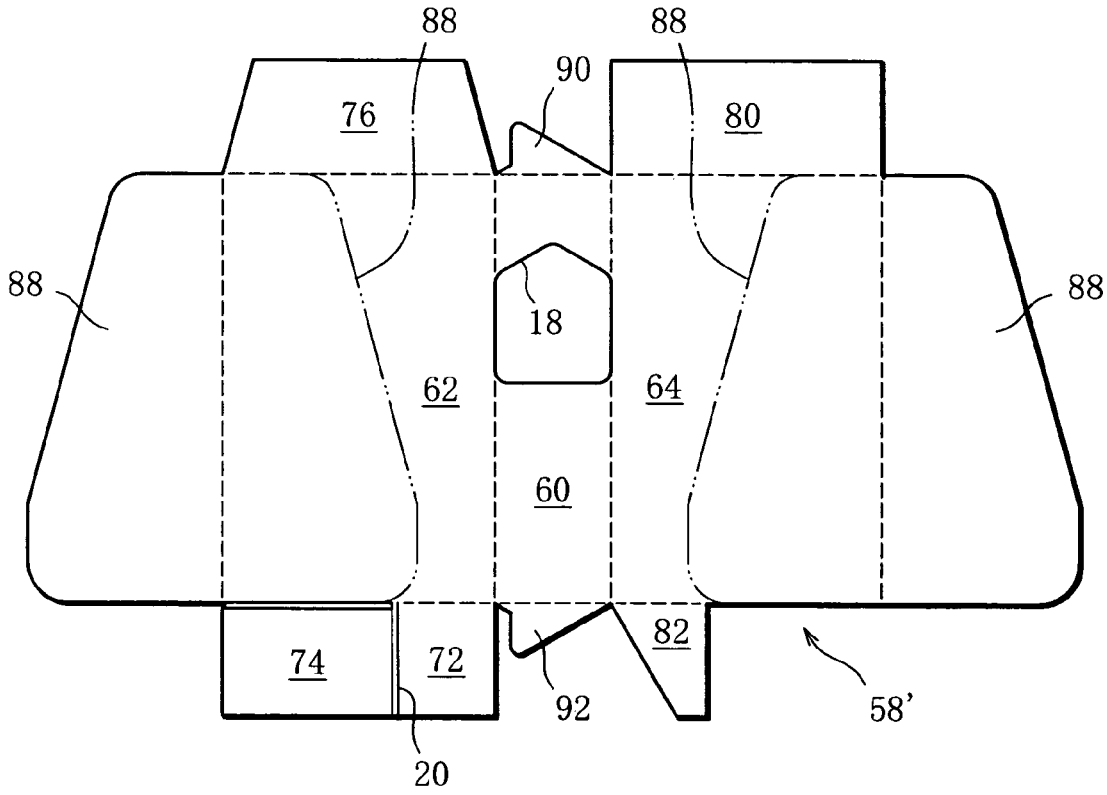
FIG. 13 shows an outer blank of the second embodiment, which is for fabricating an outer case.

FIG. 13 shows an outer blank 58' for fabricating the outer case 2.

The outer blank 58' has a pair of folding flaps or locking liners 88 that offers the same functions as the locking flap or locking liner 78, instead of having the locking flap or locking liner 78. The folding flaps or locking liners 88 are connected to a rear panel 62 and a front panel 64 as with the locking flap or locking liner 78. Side edges of the folding flaps or locking liners 88, which are located opposite to the respective panels are inclined with respect to fold lines between the respective panels. Therefore, when the folding flaps or locking liners 88 are folded toward and superposed on inner sides of the rear panel 62 and the front panel 64, distance between the side edge of each of the folding flaps or locking liners 88 and the side panel 60 is gradually increased toward an upper edge of the corresponding panel (62 or 64) as shown by chain double-dashed lines in FIG. 13.

It should be noted that the folding flaps or locking liners 88 are not bonded to the rear panel 62 and the front panel 64, and that the side edge of each of the folding flaps or locking liners 88 is raised from the corresponding panel (62 or 64).

In the case of the outer blank 58', an inner top flap 90 and an inner bottom flap 92 situated above and below the side panel 60 have the same triangular shape. A middle bottom flap 82 also has a substantially triangular shape.

The outer blank 58' is folded around the inner case 4 as with the blank 58. Consequently, the outer case 2 shown in FIG. 14, or the cigarette box, is completed.

Figure 14:
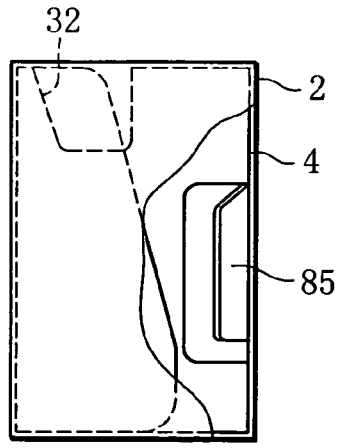
FIG. 14 shows a cigarette box fabricated out of the inner case of FIG. 12 and the outer blank of FIG. 13, partially broken away.

When the cigarette box of FIG. 14 is in a closed position, the folding flaps or locking liners 88 and the respective lugs or second stopper 85 are apart from each other in a width direction of the cigarette box. However, when the inner case 4 is turned in an opening direction, the folding flaps or locking liners 88 are engaged with the respective lugs or second stopper 85 to hamper the turning movement of the inner case 4. This determines the maximum protrusion opening or second opening of the inner case 4. In short, the folding flaps or locking liners 88 and the lugs or second stopper 85 provide a stopper for the inner case 4.

The invention is not limited to the first and second embodiments.

For example, the upper wall of the inner case 4 may be entirely open, and the push window 18 of the outer case 2 may have another shape than a pentagon.

The lugs 85 and the folding flaps 88 may be disposed only in one side of the inner case 4.

A cigarette box of a third embodiment and a blank set therefor will be described below with reference to FIGS. 15 to 21.

In descriptions of the third embodiment, members and portions providing functions identical to those of the members and portions in the first and second embodiments are provided with identical reference numerals, and explanations of these members and portions will be omitted.

Figure 15:
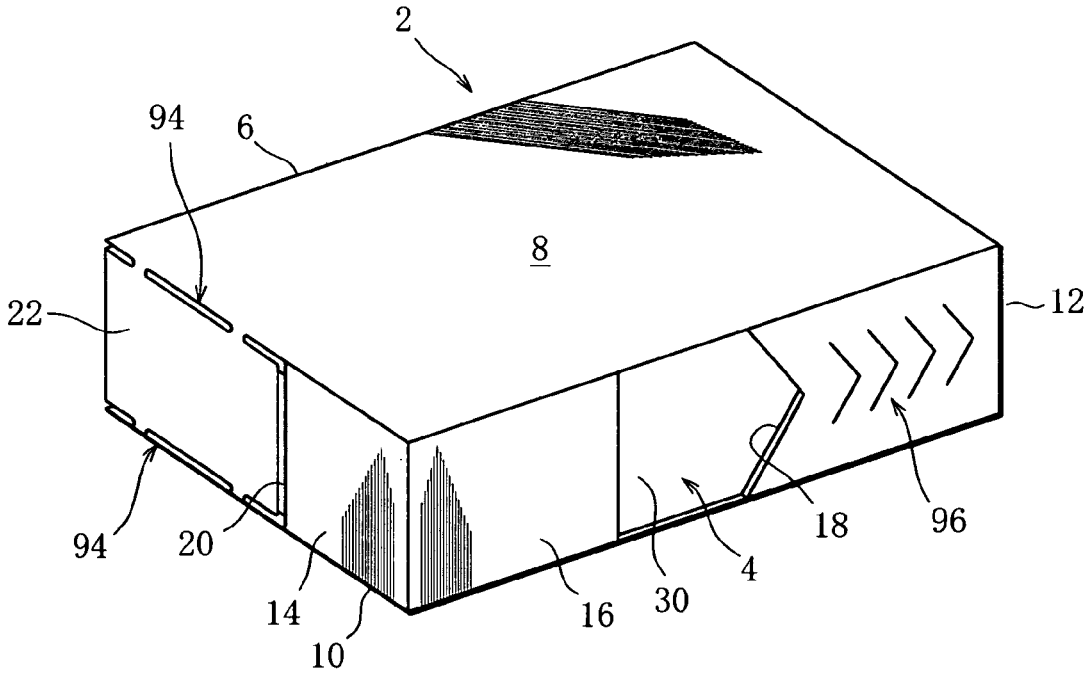
FIG. 15 is a perspective view showing a cigarette box of a third embodiment.

As illustrated in FIG. 15, when the cigarette box of the third embodiment is in a state immediately after being fabricated, a movable base 22 is connected to a front wall 8 and a rear wall 10 of an outer case 2 through perforation lines 94. Therefore, the movable base 22 is detachable from the outer case 2 along the perforation lines 94. After the movable base 22 is detached from the outer case 2, the inner case 4 becomes capable of turning around a self hinge 20 as mentioned above; in other words, the cigarette box becomes openable/closable.

As described, since the movable base 22 is detachably connected to the outer case 2 immediately after the fabrication of the cigarette box, lower edges of the front wall 8 and the rear wall 10 of the outer case 2 are never raised from a side edge of the movable base 22. Such rising of the lower edges of the front wall 8 and the rear wall 10 hinders film wrapping when the cigarette box is further wrapped in a transparent film. According to the third embodiment, however, the lower edges of the front wall 8 and the rear wall 10 are prevented from being raised, so that the film wrapping of the cigarette box is stably carried out.

As is obvious from FIG. 15, a push window 18 of the outer case 2 is situated in the center as viewed in a longitudinal direction of a side wall 16, and marks 96 are formed in an upper portion of the side wall 16. The marks 96 clearly indicate to the user which side of the push window 18 is an upper wall 12 of the cigarette box. Therefore, the user can turn the inner case 4 while properly holding the cigarette box of which the movable base 22 faces downwards.

Figure 16:
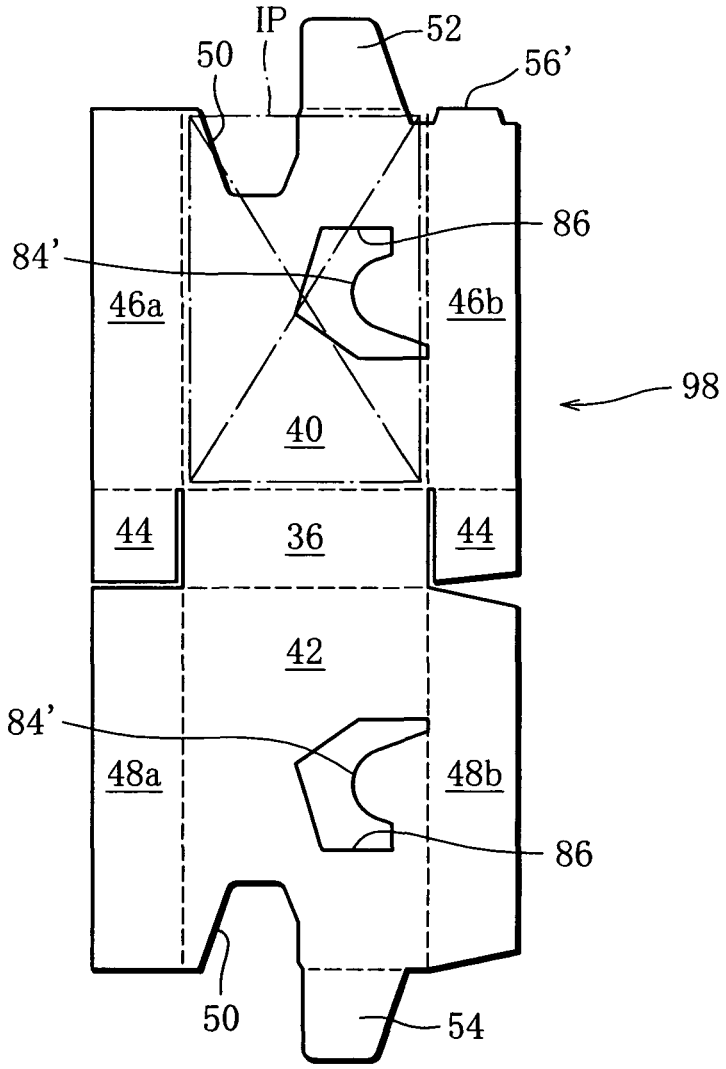
FIG. 16 shows an inner blank for fabricating an inner case of FIG. 15.

FIG. 16 shows an inner blank 98 for fabricating the inner case 4 of the third embodiment. The inner blank 98 has a projection 56' that offers the same functions as the projection 56 shown in FIG. 3 and includes a pair of lug regions 84' that provides the same functions as the lug regions 84 of the blank 34' shown in FIG. 11. The projection 56' is located in the center of an inner side flap 46*b* as viewed in a width direction of the inner side flap 46*b*, and each of the lug regions 84' has a circular arc-shaped end.

Figure 17:
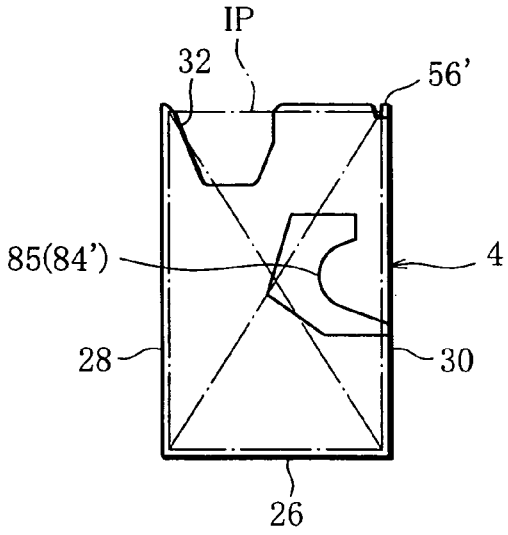
FIG. 17 shows an inner case fabricated out of the inner blank of FIG. 16.

The inner blank 98 of FIG. 16 is folded around an inner pack IP. As a result, the inner case 4 shown in FIG. 17 is fabricated. The inner case 4 has lugs 85 formed of the lug regions 84'.

Figure 18:
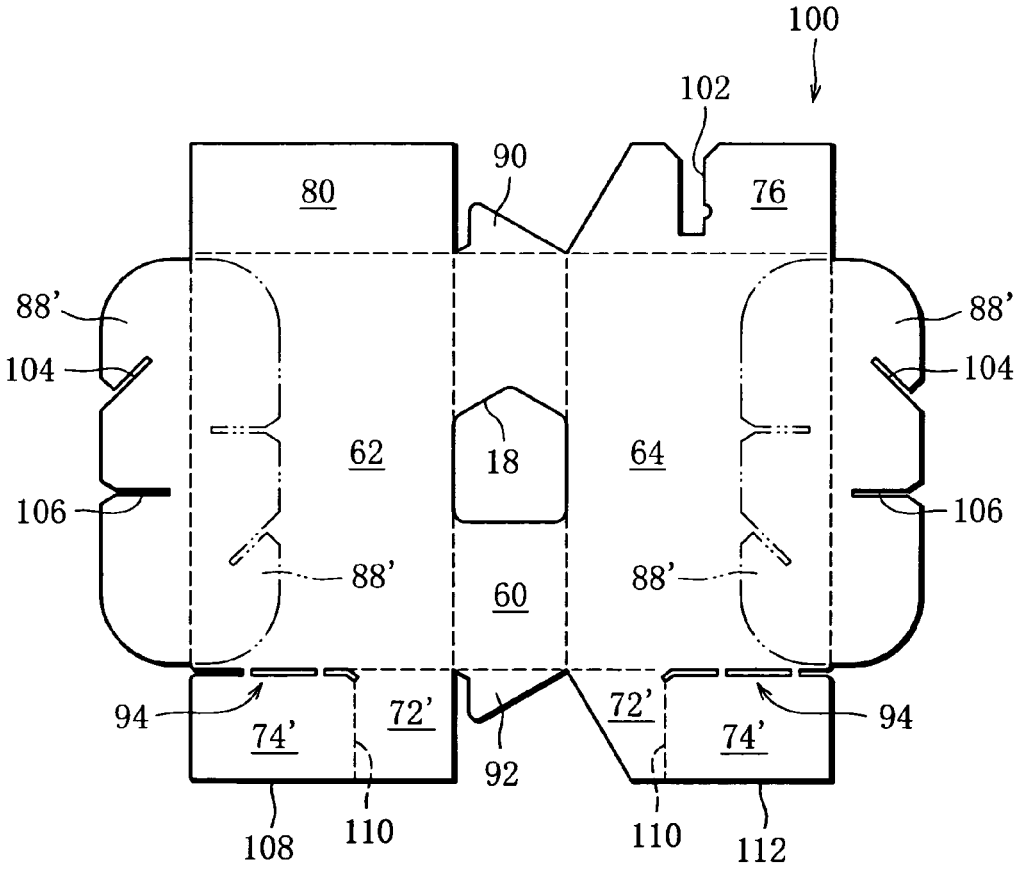
FIG. 18 shows an outer blank for fabricating an outer case of FIG. 15.

FIG. 18 shows an outer blank 100 for fabricating the outer case 2 of the third embodiment. The outer blank 100 includes an outer top panel 80 connected to an upper edge of a rear panel 62 across a fold line and an inner top panel 76 connected to an upper edge of a front panel 64 across a fold line. The inner top panel 76 has a locking groove 102 that offers the same functions as the locking flap 78 of FIG. 5. The locking groove 102 is located in the center of the inner top panel 76 as viewed in a width direction of the front panel 64, extends from an upper edge of the inner top panel 76 toward the front panel 64, and has width greater than thickness of the projection 56'.

The outer blank 100 includes a pair of folding flaps 88' that offers the same functions as the folding flaps 88 of FIG. 13. The folding flaps 88' differ from the folding flaps 88 and have outer side edges that are virtually parallel with fold lines thereof. There are formed slits 104 and 106 in the outer side edge of each of the folding flaps 88'. The slits 104 and 106 divide the outer side edge of each of the folding flaps 88' into three portions.

As is apparent from FIG. 18, an outer bottom panel 108 is connected to a lower edge of the rear panel 62 across the perforation line 94 and a fold line. The outer bottom panel 108 has a fold line 110 for forming the self hinge 20. The fold line 110 divides the outer bottom panel 108 into two regions 72' and 74' corresponding to the outer bottom flap 72 and the extension flap 74, respectively, shown in FIG. 13.

An inner bottom panel 112 is connected to a lower edge of the front panel 64 across the perforation line 94 and a fold line. The inner bottom panel 112 also has a fold line 110, which divides the inner bottom panel 112 into two regions 72' and 74'.

The outer blank 100 of FIG. 18 is folded around the inner case 4 of FIG. 17. Prior to this folding, the folding flaps 88' of the outer blank 100 are folded toward and superposed on the rear panel 62 and the front panel 64.

Figure 19:
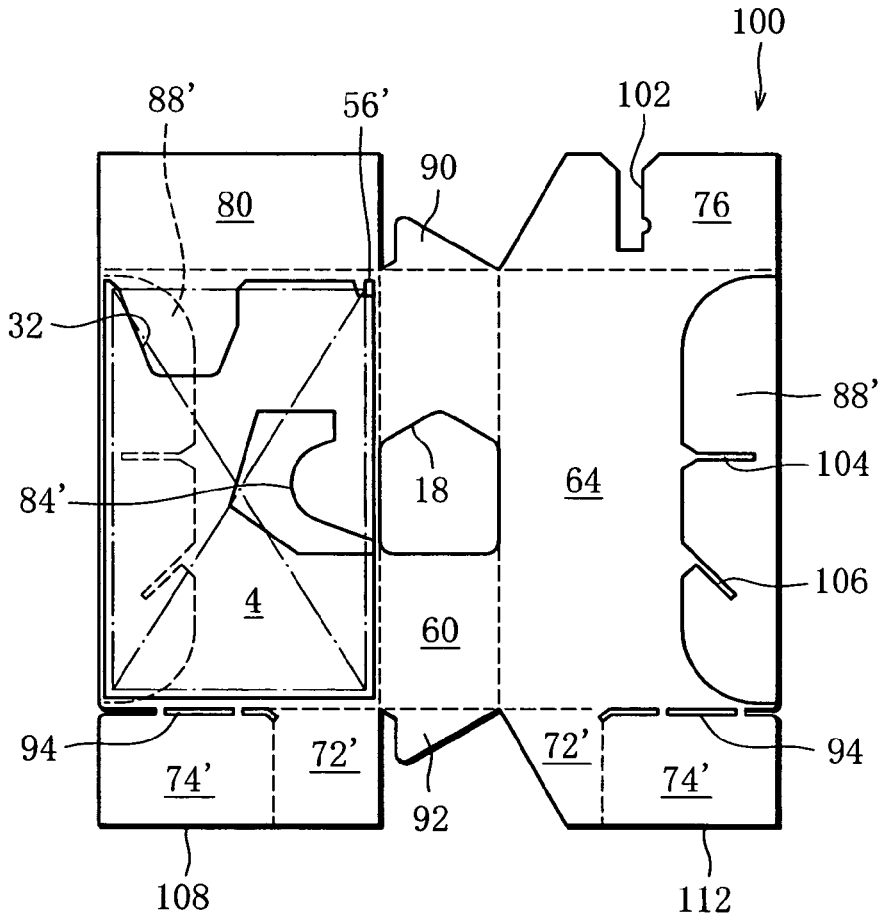
FIG. 19 shows a folding process of the outer blank of FIG. 18.
Figure 20:
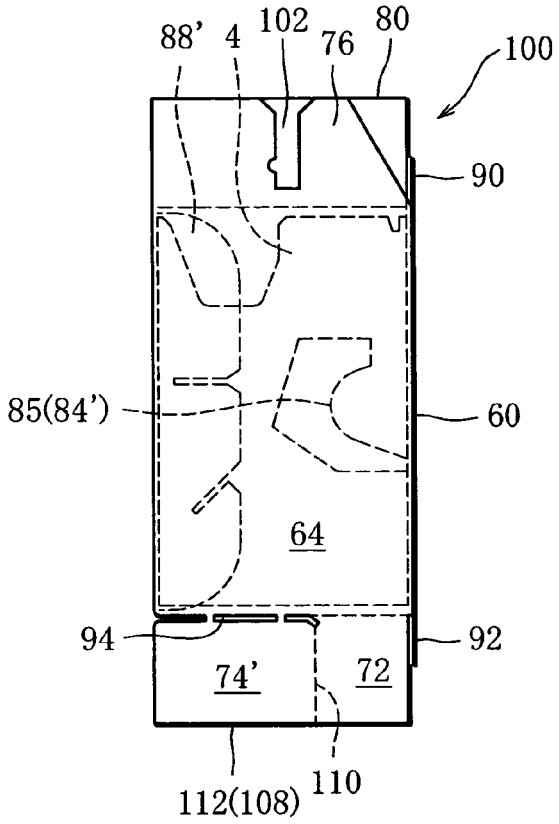
FIG. 20 shows a state in which the outer blank is further folded from the state shown in FIG. 19.

As illustrated in FIG. 19, after the inner case 4 is placed on the rear panel 63, a side panel 60 is folded toward a side wall 30 of the inner case 4. The front panel 64 is subsequently folded toward a front wall of the inner case 4. As a result, the outer blank 100 is brought into a state shown in FIG. 20.

After an inner top flap 90 of the side panel 60 is folded toward an upper face of the inner case 4, the inner top panel 76 and the outer top panel 80 are folded in order toward the upper face of the inner case 4. The inner top panel 76 and the outer top panel 80 are superposed on each other and bonded together at the same time, thereby forming the upper wall 12 of the outer case 2.

In conjunction with the folding, an inner bottom flap 92 of the side flap 60 is folded toward a bottom face of the inner case 4. The inner bottom panel 112 and the outer bottom panel 108 are then folded in order toward the bottom face of the inner case 4. The inner bottom panel 112 and the outer bottom panel 108 are superposed on each other and bonded together at the same time, thereby forming a bottom wall 14 of the outer case 2.

More specifically, the fold lines 110 of the inner bottom panel 112 and the outer bottom panel 108 coincide with each other to form the self hinge 20. The region 74' of the inner bottom panel 112 is bonded to the bottom face of the inner case 4. At this time, the fabrication of the cigarette box is completed. Consequently, the movable base 22 is formed of the regions 74' of the inner bottom panel 112 and the outer bottom panel 108. The movable base 22 is connected to the front wall 8 and the rear wall 10 of the outer case 2 across perforation lines 94.

When the inner case 4 of the cigarette box is pushed through the push window 18, the movable base 22 of the bottom wall 14 is detached away from the outer case 2 along the perforation lines 94. Therefore, the inner case 4 turns around the self hinge 20 and protrudes sideways from an open face 6 of the outer case 2.

Figure 21:
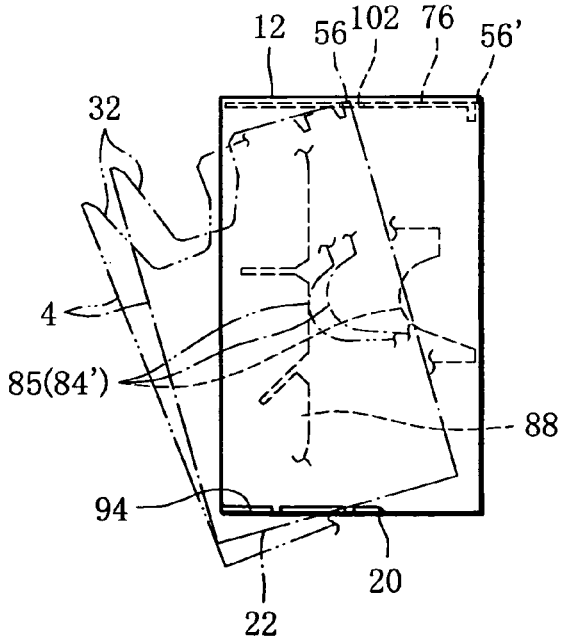
FIG. 21 is a view for explaining first and second openings of the cigarette box of the third embodiment.

As shown by a dashed line in FIG. 21, when the projection 56' of the inner case 4 reaches the locking groove 102 of the upper wall 12 (inner top panel 76) of the outer case 2, the projection 56' is locked at an inner rim of the locking groove 102. This temporarily discourages the turning movement of the inner case 4, and the cigarette box then comes into a first open position. At this time, there is secured a given gap between the lug 85 of the inner case 4 and the folding flap 88' of the outer case 2.

When the inner case 4 is further pushed out through the push window 18 or when a portion of the inner case 4, which has protruded from the outer case 2, is further pulled outward, the projection 56' and the locking groove 102 are unlocked from each other, and the inner case 4 further turns until the lug 85 is engaged with the folding flap 88' as shown by a chain-double dashed line in FIG. 21. Accordingly, the cigarette box is maintained in a second open position where a pull-up mouth 32 of the inner case 4 is open wider than in the first open position. In other words, the cigarette box of the third embodiment is capable of taking the first and second open positions.

When pushed back into the outer case 2, the inner case 4 is thoroughly accommodated in the outer case 2.

The invention claimed is:

1. A cigarette box containing an inner pack, which includes a bundle of cigarettes and a wrapping material wrapping the bundle, the cigarette box comprising:

an outer case including an open side face, a side wall with a push window, front and rear walls, and a bottom wall extending from the open side face to the side wall with the push window, the bottom wall including a first bottom portion adjacent to the side wall, wherein the first bottom portion is connected to a second bottom portion across a hinge, the second bottom portion being formed as a movable base;

an inner case that is contained in said outer case, holds an inner pack, and protrudes from the open face of said outer case in a lateral direction of said outer case when pushed through the push window of said outer case, said inner case including an outer side wall for covering the open face of said outer case, an inner side wall exposed through the push window of said outer case, front and rear walls facing the front and rear walls of the outer case, respectively, and a bottom wall coupled to the movable base of said outer case for allowing said inner case to turn around the hinge together with the movable base;

an upper wall and a pull-up mouth formed in part of the upper wall of the inner case to allow the cigarettes to be taken out, wherein when the inner case is projected from the outer case, the pull-up mouth is exposed outside of the outer case; and a stopper for determining a maximum turning angle of said inner case by engaging said inner case with an inner surface of at least one of the front and rear walls of said outer case when said inner case protrudes, wherein said stopper includes a fixed element provided to the inner surface of said outer case, the fixed element having an inner edge raised from the inner surface of said outer case, and a movable element provided to an outer surface of one of the front and rear walls of said inner case which faces the inner surface of said outer case, the movable element being engaged with the fixed element when said inner case is turned in the protruding direction, wherein the movable base of the outer case is formed of an inner bottom panel and an outer bottom panel, the inner bottom panel being on top of the outer bottom panel, wherein, before said inner case is turned for the first time, a straight separation line detachably connects the inner bottom panel of the movable base to the front wall, and another straight separation line detachably connects the outer bottom panel of the movable base to the rear wall, wherein the cigarette box further includes a film covering exposed surfaces of said outer and inner cases, the straight separation lines having such strength that the straight separation lines are torn when said inner case is pushed for the first time through the push window of said outer case by a user after said film is removed, to allow said inner case to protrude from the open side face of said outer case, and wherein multiple slits are arranged at intervals along each of the straight separation lines, and joints are provided for connecting adjacent pairs of the slits.

2. The cigarette box according to claim 1, wherein the pull-up mouth includes U-shaped notches formed in the front and rear walls of said inner case.

3. The cigarette box according to claim 1, wherein two of the slits of the straight separation lines which are nearest to the open side face of said outer case open into the open side face.

4. A blank set for fabricating a cigarette box comprising:

an inner blank for fabricating an inner case; and an outer blank for fabricating an outer case, wherein:

said inner blank includes a rear panel, a bottom panel, and a front panel that are aligned on an axis of said inner blank, in which adjacent panels are demarcated by fold lines, for forming a rear wall, a bottom wall and a front wall, respectively, of said inner case;

inner side flaps connected to both side edges of the rear panel across fold lines;

outer side flaps are connected to both side edges of the front panel, for forming an outer side wall and an inner side wall of said inner case in cooperation with the inner side flaps; and a region formed of a portion of at least of the rear panel and the front panel, for forming a lug serving as a movable element in said inner case, wherein said outer blank includes a rear panel, a side panel, and a front panel that are aligned on an axis of the outer blank, in which adjacent panels are demarcated by fold lines; the rear panel, for forming a rear wall, a side wall and a front wall, respectively, of said outer case;

an outer bottom panel connected to the rear panel across a fold line, for forming an outer surface of a bottom wall of said outer case;

an inner bottom panel connected to the front panel across another fold line;

an extension flap connected to the outer bottom panel across a hinge and another extension flap connected to the inner bottom panel across a hinge, for forming a movable base of said outer case, a straight separation line detachably connecting the outer bottom panel of the movable base to the rear panel, another straight separation line detachably connecting the inner bottom panel of the movable base to the front panel, and a top flap connected to one of the rear panel and the front panel across a fold line, for forming an upper wall of said outer case; and a folding flap connected to one of the rear panel and the front panel across another fold line, for providing a fixed element to an inner surface of said outer case.

5. The blank set according to claim 4, wherein two of the slits of the straight separation lines which are nearest to respective outer edges of the rear and front panels open into the respective outer edges.

* * * * *